US006604381B2

(12) United States Patent
Haber

(10) Patent No.: US 6,604,381 B2
(45) Date of Patent: Aug. 12, 2003

(54) JEWELRY ATTACHMENT MEANS

(75) Inventor: Adam Haber, Tenafly, NJ (US)

(73) Assignee: Midas Designs, Ltd., Tenafly, NJ (US)

( * ) Notice: Subject to any disclaimer, the term of this patent is extended or adjusted under 35 U.S.C. 154(b) by 0 days.

(21) Appl. No.: 09/928,168

(22) Filed: Aug. 10, 2001

(65) Prior Publication Data

US 2003/0029192 A1 Feb. 13, 2003

(51) Int. Cl.[7] ..... A44C 25/00
(52) U.S. Cl. ..... 63/23; 63/21
(58) Field of Search ..... 63/1.14–1.18, 63/3.1, 18, 19, 20, 21, 22, 43; 40/1.6, 655

(56) References Cited

U.S. PATENT DOCUMENTS

| | | | | | |
|---|---|---|---|---|---|
| 331,798 | A | | 12/1885 | Lettre | |
| 1,434,590 | A | | 11/1922 | Chafetz | |
| 2,061,655 | A | | 11/1936 | Granat | |
| D109,800 | S | | 5/1938 | Foss | |
| 2,138,596 | A | | 11/1938 | Fassnacht | |
| 2,462,425 | A | | 2/1949 | Pratt et al. | |
| D155,167 | S | | 9/1949 | Kerchner | |
| RE24,798 | E | | 3/1960 | Lund | |
| 3,122,900 | A | | 3/1964 | Beghetto, Jr. | |
| 4,028,908 | A | | 6/1977 | Michael | |
| 4,530,221 | A | * | 7/1985 | Weinberg | 24/116 A |
| 4,581,904 | A | * | 4/1986 | Lehmann et al. | 446/310 |
| 4,611,368 | A | * | 9/1986 | Battersby | 24/116 A |
| 5,022,127 | A | * | 6/1991 | Ang | 24/712.2 |
| 5,022,237 | A | | 6/1991 | Monderer et al. | |
| 5,031,420 | A | | 7/1991 | Song | |
| 5,214,940 | A | * | 6/1993 | Capifali | 24/633 |
| 5,257,512 | A | * | 11/1993 | Febrer | 24/643 |
| 5,479,795 | A | | 1/1996 | Neri | |
| 5,606,874 | A | | 3/1997 | Archetti et al. | |
| 5,687,585 | A | * | 11/1997 | Ferrell | 24/116 A |
| 5,722,260 | A | * | 3/1998 | Mangano | 24/71 J |
| 5,758,516 | A | * | 6/1998 | Uematsu | 63/1.14 |
| 6,298,650 | B1 | * | 10/2001 | Amundsen et al. | 59/80 |
| 6,422,036 | B1 | * | 7/2002 | Giannis et al. | 63/3.1 |

* cited by examiner

*Primary Examiner*—J. J. Swann
*Assistant Examiner*—André L. Jackson
(74) *Attorney, Agent, or Firm*—Stephen E. Feldman

(57) ABSTRACT

There is disclosed a jewelry attachment having a face member and a rear member hingeably secured to one another. The face member and the rear member are spaced apart from one another when in a closed condition by upwardly extending wall portions provided on the inner surface of the face member. An inverted L-shaped retaining bar member is provided at an end of the jewelry attachment opposite the hinge. Mating lock members are provided on the inner surfaces of the rear member and the face member to securely lock them together in a closed condition. A pair of channels is formed within the closed jewelry attachment one of the channels being capable of receiving therein a first article of jewelry and the other channel being capable of receiving therein a second, separate article of jewelry.

14 Claims, 4 Drawing Sheets

FIG. 5
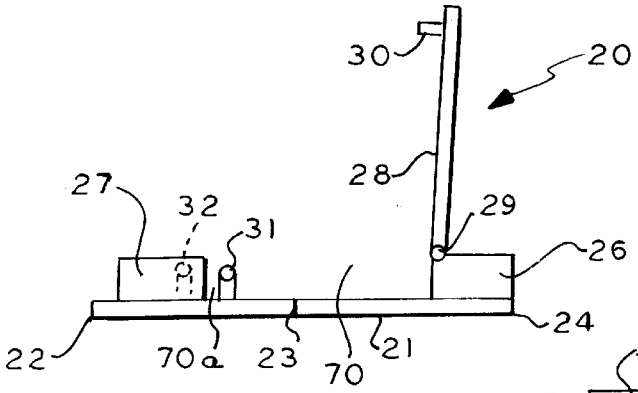
FIG. 8
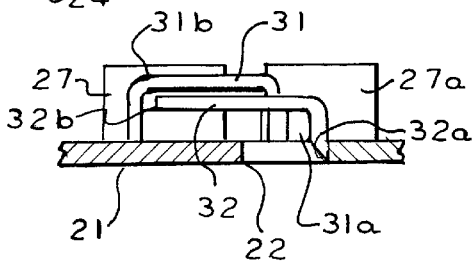
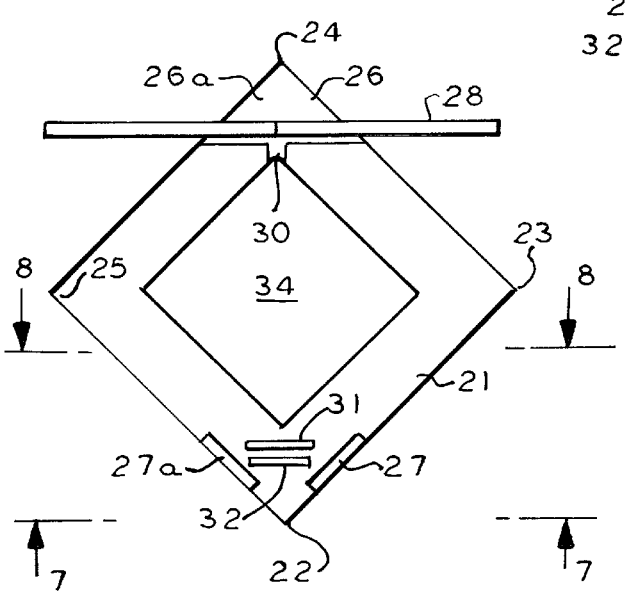
FIG. 6
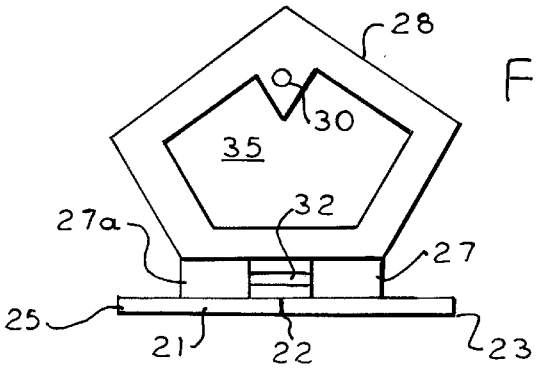
FIG. 7

JEWELRY ATTACHMENT MEANS

FIELD OF THE INVENTION

This invention is directed toward a jewelry attachment means that permits one article of jewelry such as a pendant, charm, or the like to be attached to another article of jewelry such as a necklace, chain, bracelet, anklet, and the like. More particularly, this invention is directed toward a single unit jewelry attachment means that enables a user to readily and easily securely attach two, separate or different articles of jewelry to each other without fear of having the attachment means becoming undone and losing an article of jewelry. Even more particularly, the jewelry attachment means of the invention permits a plurality of jewelry articles to be securely connected to one another or a plurality of jewelry articles such as pendants, charms, and the like to be securely connected to a single article of jewelry such as a necklace, chain, bracelet, anklet, or the like.

BACKGROUND OF THE INVENTION

Various jewelry attachment devices have been developed through the years and are well known. For example, U.S. Pat. No. 331,798 to Lettre discloses a bracelet having flexible side portions attached to a centered jewelry ornament to facilitate attaching and removing the bracelet.

U.S. Pat. No. 1,434,590 to Chafetz discloses a finger ring having another ring mounted transverse to it to hold a cigarette.

U.S. Pat. No. 2,061,655 to Granat discloses a means to attach a pair of rings such as an engagement ring and a wedding band to each other to prevent the rings from moving, accidentally falling off a finger, and to impart balance of the rings to the wearer.

U.S. Pat. No. 2,138,596 to Fassnacht discloses a bracelet or chain necklace equipped with circular links to which charms or other jewelry adornments can be attached.

U.S. Pat. Des No. 109,800 to Foss discloses a finger ring having charms attached to it.

U.S. Pat. No. 2,462,425 to Pratt, et.al. discloses a clasp for securing the ends of a flexible strand of jewelry such as a snake chain, braid, string o pearls, string of beads, and the like to each other. The locking element of the clasp has a body portion carrying a hinged member and a latching nose at the opposite end of the hinge which engages a lip formed on the upper end of the body portion of the locking element.

U.S. Pat. Des No. 155,167 to Kerchner discloses an ornamental finger ring having a rope like element coiled about it that forms the mounting means for setting gemstones.

U.S. Pat. Re No. 24,798 to Lund discloses a double or side-by-side U-shaped channel member for securing two finger rings together such as an engagement ring and a wedding band to prevent movement of the rings relative to one another and to prevent accidental loss of that ring worn closest to the end of the wearer's finger.

U.S. Pat. No. 3,122,900 to Baghetto, Jr. discloses a locking means to secure a pendant to a necklace chain. The locking means has an inverted, U-shaped locking wire positioned between adjacent loops attached to a pendant so that the U-shaped locking wire would be transverse to a necklace chain. One end of the U-shaped locking wire is threaded into a first, threaded hole provided in the pendant mounting base and the other end of the U-shaped locking wire is received in a second hole formed in the pendant mounting base opposite the first, threaded hole.

U.S. Pat. No. 4,028,908 to Michael discloses a school ring charm having an eyelet and a loop for connecting the charm to a neck chain or the like.

U.S. Pat. No. 5,022,237 to Monderer, et.al. discloses a jewelry attachment means for attaching a charm to a bracelet so as not to obscure the upper surface of the bracelet or gemstones that might be set in the upper surface of the bracelet. The attachment means has parallel, U-shaped members that fit over the bracelet and a rotatable locking arm and female member that secure the U-shaped members to the bracelet.

U.S. Pat. No. 5,031,420 to Song discloses a jewelry attachment means for attaching a pendant to a necklace. The attachment means has a pair of interlocking, arcuate elements which are positioned at a right angle to one another. A first element intended to receive a necklace or chain has an arm swivably attached at one end to engage the other end of the element when the arm is swiveled to a closed position. A second element receives a connecting loop on the pendant to be attached to the necklace or chain. The second element has a locking bar swivably attached adjacent an eyelet at one end of the element. The eyelet receives the first latching element before its arm is swiveled to a closed position.

U.S. Pat. No. 5,479,795 to Neri discloses a fish hook shaped clasp for connecting the ends of a bracelet or necklace together. The fish hook is seated and secured between two housing members and is engaged by a rotatable member whose free end is configured to interact with the free end of the fish hook.

U.S. Pat. No. 5,606,874 to Archetti, et.al. discloses a detachable jewelry ornamentation device that can be selectively secured at different positions on a necklace, bracelet, anklet, or the like. The device has a base plate member with a clamping arm pivotally secured to one end thereof; a clamping zone means intermediate the ends of the plate member; and means to engage the clamping arm in a closed position. A necklace, bracelet, anklet, or the like is positioned on the clamping zone means and the clamping arm is pivoted over it to secure the device to the jewelry article at that point.

While the jewelry attachment means described above are useful and are of interest, they generally require relatively complex maneuvers to complete attachment, are limited in their utility and are costly to manufacture.

By contrast, the jewelry attachment means of this invention permits a user to readily and easily attach separate articles of jewelry to one another with the assurance that the jewelry articles are secure and will not become separated and accidentally lost. The jewelry attachment means of this invention is also flexible to permit several articles of jewelry to be attached to one another or to permit several articles of jewelry to be attached to a single article of jewelry or combinations thereof. In addition, the jewelry attachment means of this invention is of relatively simple construction making it economical to produce.

SUMMARY OF THE INVENTION

In general, the jewelry attachment means of the invention comprises: a face member having opposed, spaced apart ends and opposed, spaced apart sides; wall portions perpendicularly extending from said sides adjacent each of said ends; a rear member having opposed, spaced apart ends and opposed spaced apart sides; hinge means hingeably securing said face member to said rear member adjacent common ends of said face member and said rear member; an inverted, L-shaped retaining bar member secured to said face member adjacent said wall portions at that end of said face member opposite said hinge means; and, lock means to securely lock said face member to said rear member.

When the rear member is securely locked to the face member, a pair of spaced apart channels are formed within the attachment means. One channel is formed adjacent the hinge means and can serve to receive a necklace, bracelet, anklet and the like. The other channel is formed between the inverted L-shaped retaining bar and the end opposite the hinge end and can serve to receive a pendant, charm, or the like.

While any suitable lock means can be used to secure the face member to the rear member, the lock means in one embodiment of the invention is provided by one or more male lock members protruding from the inner surface of the rear member which mate with female lock members provided on the upwardly extending walls adjacent the L-shaped retaining member.

The L-shaped retaining bar member is preferably positioned so that its short leg is secured to the inner surface of the face member and its long leg extending substantially parallel to the inner surface of the face member adjacent one end thereof between the upwardly extending wall portions.

The jewelry attachment means can be produced to have any desired geometric configuration when the face member and the rear member are securely locked to one another. For example, the shape of the jewelry attachment means can be oval, round or circular, spherical, triangular, square, diamond, heart, hour glass, and the like or can be a free form configuration.

DESCRIPTION OF THE DRAWING

The jewelry attachment means of the invention is further illustrated by the various embodiments contained in the accompanying drawing wherein:

FIG. 5 is a side elevation view of another embodiment of the jewelry attachment means of the invention shown with the rear member in an open position;

FIG. 6 is a top plan view of the jewelry attachment means shown in FIG. 5;

FIG. 7 is a view taken substantially in the direction of lines 7—7 of FIG. 6;

FIG. 8 is a view taken substantially on the line 8—8 of FIG. 6;

DETAILED DESCRIPTION OF THE DRAWING AND THE INVENTION

Figure 1:
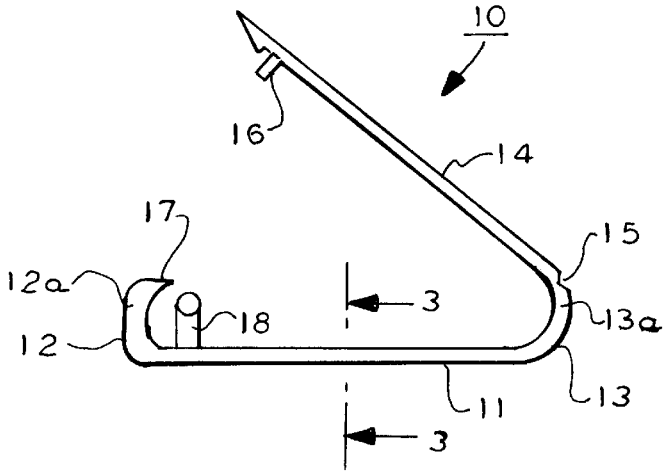
FIG. 1 is a side elevation view of one embodiment of the jewelry attachment means shown with the rear member in an open position.

Details of the various embodiments of the jewelry attachment means of the invention will become more apparent from the ensuing description when considered together with the accompanying drawing wherein like reference numerals and letters denote like parts.

The present invention is directed toward a jewelry attachment means designed to enable a person securely and easilty interchange a pendant with variety of a necklaces, bracelets, chains, anklets and the like.

Figure 2A:
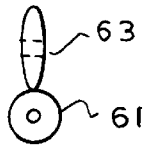
FIG. 2*a* is a front view of a pendant that may be fixed to the jewelry attachment means shown in each of the figures.
Figure 2:
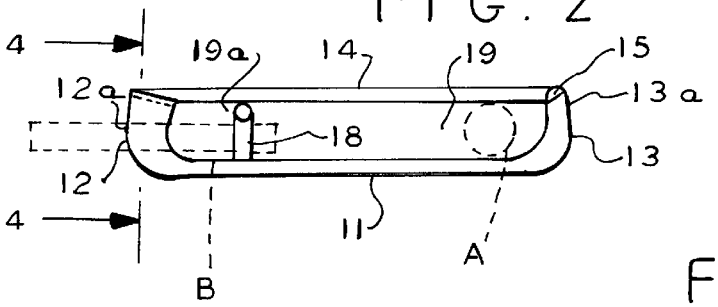
FIG. 2 is a side elevation of the jewelry attachment means shown in FIG. 1 with the rear member in a closed and locked position.
Figure 3:
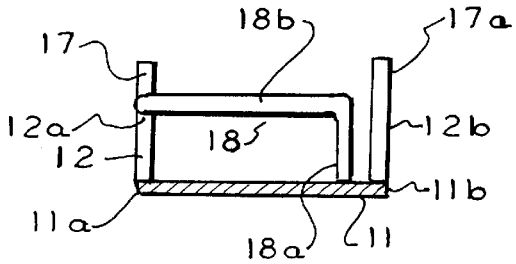
FIG. 3 is a view taken substantially on the line 3—3 of FIG. 1.
Figure 4:
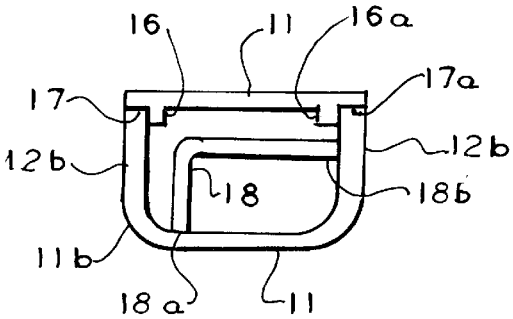
FIG. 4 is a view taken substantially on the line 4—4 of FIG. 2.

With reference first to FIGS. 1–4, one embodiment of the jewelry attachment means of the invention is illustrated. In this embodiment, the geometric shape of the attachment means is oblong and is generally identified by reference numeral 10. The face member 11 of the attachment means 10 has opposed, spaced apart sides 11*a* and 11*b* (FIGS. 3 an 4) and opposed, spaced apart ends 12 and 13 in the form of upwardly extending wall portions 12*a* and 12*b* and 13*a* and 13*b* (not shown). An opening is formed between wall portions 12*a* and 12*b*. This opening should be of a sufficient width to allow a pendant connecting means 63 to rest in between wall portions 12*a* and 12*b* and be set within attachment means 10.—A rear member 14 is hingeably secured to the upper ends of upwardly extending wall portions 13*a* and 13*b* as indicated at 15. A pair of spaced apart male locking prong members 16 and 16*a* (FIG. 4) are secured to the inner surface of rear member 14 at the end opposite the hinge means 15 to mate with female lock means 17 and 17*a* provided at the upper ends of upwardly extending wall portions 12*a* and 12*b* (FIGS. 3 and 4).

Spaced inwardly from but adjacent to upwardly extending wall portions 12*a* and 12*b* is an inverted, L-shaped retaining bar member 18 for setting pendant 61 to attachment means 10. Generally, a pendant connecting means 63, such as a bail, is inserted onto member 18. Pendant connecting means should pass through the opening between wall portions 12*a* and 12*b* with pendant 61 hanging from below attachment means 10. The short leg 18*a* of retaining bar member 18 is secured to the inner surface of face member 11 so that the long leg 18*b* of retaining bar member 18 extends between upwardly extending wall portions 12*a* and 12*b* substantially parallel to the inner surface of face member 11 (FIGS. 3 and 4). Long leg 18*b* should be longer than the opening between wall portions 12*a* and 12*b*. This will prevent the pendant 61 from falling of retaining bar member 18.

Figure 13:
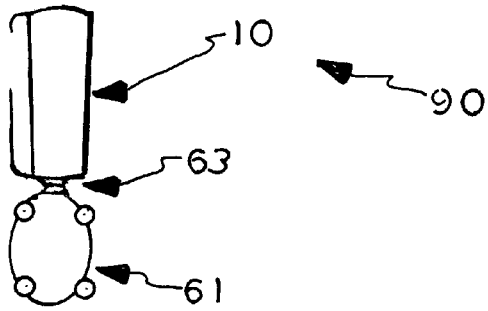
FIG. 13 is a front view of a pendant and necklace set on the jewelry attachment means of FIGS. 1–4.

When rear member 14 is securely locked to face member 11, a pair of open channels 19 and 19*a* are formed within the attachment means as shown in FIG. 2. As can be seen, one channel 19 is formed between upwardly extending end walls 13*a* and 13*b* and retaining bar member 18 while the other channel 19*a* is formed between retaining bar member 18 and upwardly extending walls 12*a* and 12*b*. Channel 19 can be used to receive necklace 90, bracelet, anklet, or the like in phantom by A while channel 19*a* can be used to receive a—pendant, charm, or other article of jewelry as indicated in phantom by B. In this manner, a pendant, charm, or other article of jewelry can interchangeably be securely fastened to a variety of necklaces, bracelets, anklets, or the like as shown in FIG. 13.

FIGS. 5–8 illustrate another embodiment of the jewelry attachment means of the invention which, in this embodiment, is geometrically configured in the shape of a diamond. In this embodiment, the jewelry attachment means, generally identified by reference numeral 20, has a face member 21 in the form of a diamond (FIG. 6) having opposed corners 22, 23 and 24, 25, wall portions 27, 27*a* extending upwardly from the inner surface of face member 21 adjacent corner 22 and wall portions 26, 26*a* extending upwardly adjacent the opposite corner 24. An opening is formed between wall portions 27 and 27*a*. This opening should be of a sufficient width to allow a pendant connecting means 63 to rest in between wall portions 27 and 27*a* and be set within attachment means 20. Jewelry attachment means 20 is provided with female lock member 31 secured to the inner surface of face member 21. Similarly, a male lock prong member 30 is secured to the inner surface of rear member 28 at that end of the rear member opposite the hinge means 29 (FIGS. 5, 6 and 7). Rear member 28 is also diamond shaped (FIG. 7) and is hingeably secured to face member 21 at the upper ends of upwardly extending wall members 26, 26*a* as indicated at 29 (FIG. 5).

In this embodiment, a pair of spaced apart, inverted, L-shaped retaining bar members 32 is secured to the inner surface of face member 21 adjacent corner 22. Retaining bar member 32 is used for setting pendant 61 to jewelry attachment means 20. Generally, a pendant connecting means 63, such as a bail, is inserted onto retaining bar member 32. Pendant connecting means should pass through the opening between wall portions 27 and 27*a* with pendant 61 hanging from below attachment means 20.—The short legs 32*a* of retaining bar member 32, is secured to the inner surface of face member 21 so that long legs 32*b*, respectively, extend substantially parallel to female lock member 31 between upwardly extending walls 27 and 27*a* as illustrated in FIGS. 6 and 8. Long leg 32*b* should be longer than the opening between wall portions 27 and 27*a*. This will prevent the pendant 61 from falling of retaining bar member 18.

Figure 14:
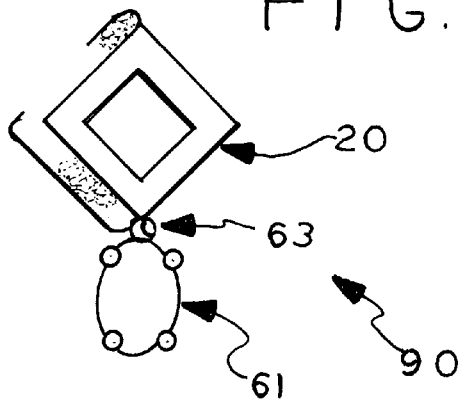
FIG. 14 is a front view of a pendant and necklace set on the jewelry attachment means of FIGS. 5–8.
Figure 15:
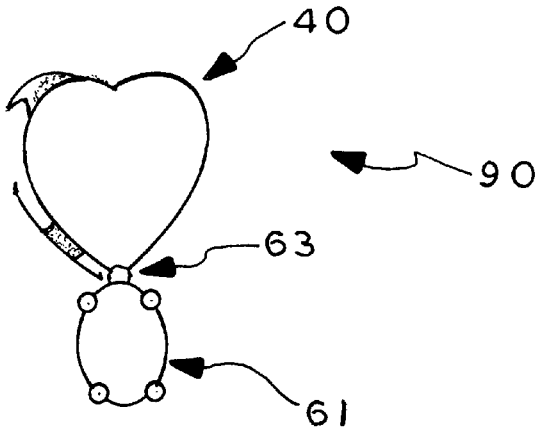
FIG. 15 is a front view of a pendant and necklace set on the jewelry attachment means of FIGS. 9–12.

Channels 70 and 7*a* are formed within jewelry attachment means 20. Channel 70 is formed between upwardly extending end walls 26 and 26*a* and L-shaped retaining member 321. Channel 70*a* is formed between L-shaped retaining member 32 and upwardly extending walls 27 and 27*a*. Channel 70 should be used to receive a necklace 90, bracelet, anklet, or the like while channel 70*a* should be used to receive a pendant, charm, or other article of jewelry. In this manner, a pendant, charm, or other article of jewelry can interchangeably be securely fastened to a variety of necklaces, bracelets, anklets, or the like as shown in FIG. 14

As is evident from FIGS. 6 and 7, both the face member 21 and the rear member 28 have cutouts 34 and 35, respectively, formed in them that correspond to their perimeter diamond shapes.

Figure 9:
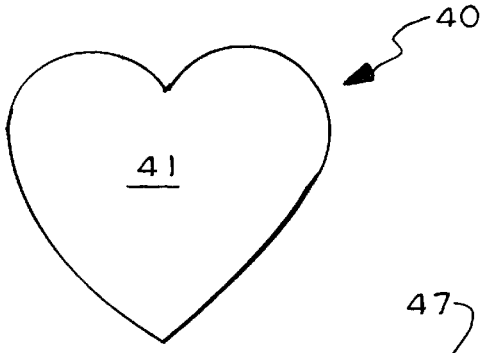
FIG. 9 is a top plan view of a further embodiment of the jewelry attachment means of the invention.
Figure 10:
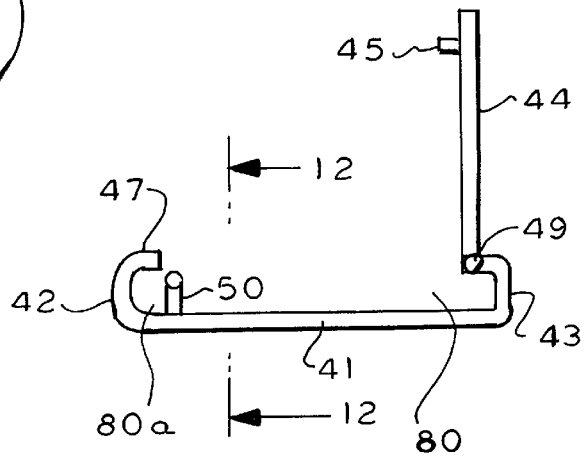
FIG. 10 is a side elevation view of the jewelry attachment means shown in FIG. 9.
Figure 11:
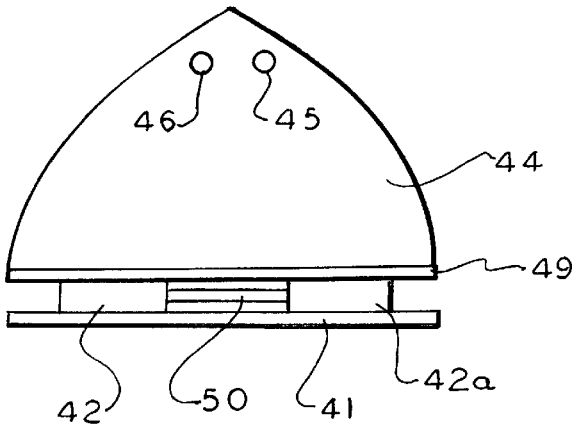
FIG. 11 is a front view of the jewelry attachment means shown in FIG. 10.

In the further embodiment of the jewelry attachment means of the invention illustrated in FIGS. 9–12, the attachment means, generally identified by reference numeral 40, is shown in FIG. 9 to have a heart shape. In this embodiment, face member 41 has opposed, spaced apart upwardly extending walls 42 and 42*a* and 43, each of which curve inwardly toward one another as shown in FIG. 10. An opening is formed between wall portions 42 and 42*a*. This opening should be of a sufficient width to allow a pendant connecting means 63 to rest in between wall portions 42 and 42*a* and be set within attachment means 20.-Rear member 44 is hingeably secured, as indicated at 49, at one end to the inner extremity of upwardly extending wall 43 and has a pair of male locking members 45 and 46 secured to its inner surface adjacent its other end as can be seen in FIGS. 10 and 11. The inner extremities of upwardly extending walls 42 and 42*a* are provided with female locking members as indicated at 47 and 48 (FIG. 12) which engage the male locking members 45 and 46 when the rear member 44 is rotated toward face member 41 to securely lock rear member 44 to face member 41.

Figure 12:
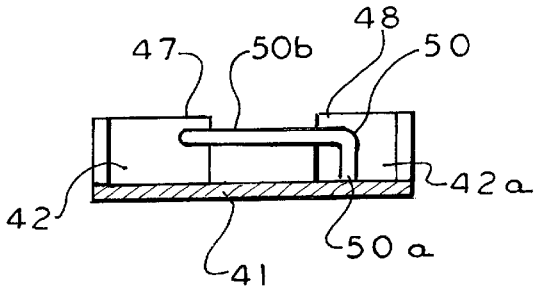
FIG. 12 is a view taken substantially on the line 12—12 of FIG. 10;.

Spaced inwardly from but adjacent to upwardly extending wall members 42 and 42*a* is an inverted, L-shaped retaining bar member 50 whose short leg 50*a* is secured to the inner surface of face member 41 and whose long leg 50*b* is disposed transverse to the upwardly extending wall members 42 and 42*a* substantially parallel to the inner surface of the face member 41 as shown in FIG. 12. Retaining bar member 50 is used for setting pendant 61 to jewelry attachment means 40. Generally, a pendant connecting means 63, such as a bail, is inserted onto retaining bar member 50. Pendant connecting means should pass through the opening between wall portions 42 and 42*a* with pendant 61 hanging from below attachment means 40.

Referring to FIG. 9, channels 80 and 80*a* are formed within jewelry attachment means 40 when rear member 44 is securely locked to face member. Channel 70 is formed between upwardly extending wall 43 and L-shaped retaining member 50. Channel 70*a* is formed between L-shaped retaining member 50 and the inner surfaces of upwardly extending walls 42 and 42*a*. Channel 80 should be used to receive a necklace 90, bracelet, anklet, or the like while channel 80*a* should be used to receive a pendant, charm, or other article of jewelry. In this manner, a pendant, charm, or other article of jewelry can interchangeably be securely fastened to a variety of necklaces, bracelets, anklets, or the like as shown in FIG. 14.

Although the invention has been described in some detail and with particularity, it will be appreciated that changes and modifications can be made therein without departing from the scope and spirit of the invention. charm, or other article of jewelry. In this manner, a pendant, charm, or other article of jewelry can interchangeably be securely fastened to a variety of necklaces, bracelets, anklets, or the like as shown in FIG. 14

Although the invention has been described in some detail and with particularity, it will be appreciated that changes and modifications can be made therein without departing from the scope and spirit of the invention.

What is claimed:

1. A jewelry attachment means comprising:

(a) a face member having opposed, spaced apart ends and opposed, spaced apart sides;

(b) wall portions extending perpendicularly upward from said sides adjacent to said ends, with an opening between said wall portions;

(c) a rear member having opposed, spaced apart ends and opposed, spaced apart sides;

(d) a means to hingeably secure said face member to said rear member at common ends of said face member and said rear member;

(e) an inverted, L-shaped retaining bar member secured to the inner surface of said face member adjacent (to) said upwardly extending wall portions that are opposite said hinge means;

(f) said inverted, L-shaped retaining bar member being longer than said wall portions so as to prevent an attached pendant from falling off of said inverted, L-shaped retaining bar member; and (g) a lock means to securely lock said face member to said rear member when said rear member is rotated onto said face member to close said attachment means.

2. The jewelry attachment means of claim 1 wherein a short leg of said L-shaped retaining bar member is secured to the inner surface of said face member and a long leg of said L-shaped retaining bar member is disposed substantially parallel to the inner surface of said face member.

3. The jewelry attachment means of claim 1 wherein said lock means comprises a male lock member secured to the inner surface of said rear member and a mating female lock member is provided on said upwardly extending wall portions adjacent said L-shaped retaining bar member.

4. The jewelry attachment means of claim 1 wherein a pair of channels is formed in said attachment means when said rear member is securely locked to said face member, one of said channels being capable of receiving therein a first article of jewelry and the other of said channels being capable of receiving therein a second, separate article of jewelry.

5. The jewelry attachment means of claim 4 wherein one of said channels is formed between said hinge means and said L-shaped retaining bar member and the other of said channels is formed between said L-shaped retaining bar member and said upwardly extending wall portions adjacent thereto.

6. The jewelry attachment means of claim 1 which has a geometric oblong shape.

7. The jewelry attachment means of claim 1 which has a geometric diamond shape.

8. The jewelry attachment means of claim 1 which has a geometric heart shape.

9. A jewelry attachment means comprising:

(a) a face member having opposed, spaced apart ends and opposed, spaced apart sides;

(b) wall portions extending perpendicularly upward from said sides adjacent said ends of said face member, with an opening between said wall portions;

(c) a rear member having opposed, spaced apart ends and opposed spaced apart sides;

(d) a hinge means to hingeably secure said face member to said rear member at common ends of said face member and said rear member;

(e) an inverted L-shaped retaining bar member secured to the inner surface of said face member adjacent said upwardly extending wall portions that are opposite said hinge means, a short leg of said L-shaped retaining bar member being secured to said inner surface of said face member and a long leg of said L-shaped retaining bar member being disposed substantially parallel to said inner surface of said face member, wherein said long leg of said L-shaped retaining bar member is longer than said opening;

(f) a lock means to securely lock said face member to said rear member when said rear member is rotated to close said attachment means such that when said attachment means is in a securely locked and closed condition, a pair of channels is formed therein, one of said channels being capable of receiving therein a first article of jewelry and the other of said channels being capable of receiving therein a separate article of jewelry.

10. The jewelry attachment means of claim 9 wherein said lock means comprises a male lock member secured to the inner surface of said rear member and a mating female lock member is provided on said upwardly extending wall portions adjacent said L-shaped retaining bar member.

11. The jewelry attachment means of claim 9 wherein one of said channels is formed between said hinge means and said L-shaped retaining bar member and the other of said channels is formed between said L-shaped retaining bar member and said upwardly extending wall portions adjacent thereto.

12. The jewelry attachment means of claim 9 which has a geometric oblong shape.

13. The jewelry attachment means of claim 9 which has a geometric diamond shape.

14. The jewelry attachment means of claim 9 which has a geometric heart shape.

* * * * *